United States Patent [19]

Pelters et al.

[11] Patent Number: 5,058,380

[45] Date of Patent: Oct. 22, 1991

[54] EXHAUST SYSTEM OF AN INTERNAL-COMBUSTION ENGINE

[75] Inventors: Stephan Pelters, Tiefenbronn; Horst Klink, Weissach, both of Fed. Rep. of Germany

[73] Assignee: Dr. Ing. h.c.F. Porsche AG, Fed. Rep. of Germany

[21] Appl. No.: 480,962

[22] Filed: Feb. 16, 1990

[30] Foreign Application Priority Data

Mar. 10, 1989 [DE] Fed. Rep. of Germany ..... 3907776

[51] Int. Cl.[5] ..... F01N 3/28

[52] U.S. Cl. ..... 60/288; 422/172; 422/180

[58] Field of Search ..... 60/288; 422/171, 172, 422/180, 237; 55/309, 314

[56] References Cited

U.S. PATENT DOCUMENTS 3,440,817 4/1969 Sauferer ..... 60/288
3,972,184 8/1976 Warren ..... 60/288
4,671,810 6/1987 Dietzsch ..... 55/309

FOREIGN PATENT DOCUMENTS 2132752 1/1973 Fed. Rep. of Germany ..... 60/288
97920 5/1978 Fed. Rep. of Germany .
5359128 5/1973 Japan .
1344922 10/1987 U.S.S.R. ..... 60/288

*Primary Examiner*—Douglas Hart
*Attorney, Agent, or Firm*—Evenson, Wands, Edwards, Lenahan & McKeown

[57] ABSTRACT

An exhaust system of an internal-combustion engine is provided with a small catalyst as a starting catalyst and wherein this small catalyst is longitudinally movably or pivotedly movable into or out of the exhaust pipe of an internal-combustion engine. When exhaust gas flow from the engine is strong, the catalyst is moved into a dead space lateral chamber with respect to the flow in the exhaust pipe.

17 Claims, 2 Drawing Sheets

EXHAUST SYSTEM OF AN INTERNAL-COMBUSTION ENGINE

BACKGROUND AND SUMMARY OF THE INVENTION

The invention relates to an exhaust system of an internal-combustion engine having a movable catalyst which is arranged to be moved into and out of an exhaust pipe of the engine.

When a catalyst is to be used for purifying the exhaust gas flow of an internal-combustion engine, this catalyst must meet two requirements: fast heating and resistant to overheating. The simultaneous meeting of these requirements makes it necessary that special measures be taken. After the start of its operation, the catalyst must be very rapidly brought to such a high temperature that it can be used for purifying the exhaust gas. For this purpose, a small catalyst is optimally suitable and is installed in the exhaust pipe as closely as possible to the internal-combustion engine. In order to avoid overheating of the small catalyst during high engine performance and correspondingly large and hot exhaust gas flow and to prevent destruction by overheating, the exhaust gases can be guided around the catalyst in a bypass pipe (see U.S. Pat. No. 3,972,184). Flaps are used for controlling the bypass pipe. Here the exhaust gas flow is diverted. This results in an additional loss of pressure and an overheating of the catalyst is not rendered impossible.

An object of the instant invention is to provide an exhaust system for an internal-combustion engine which is safe in its operation and has a low exhaust gas back pressure.

This object is achieved by having the catalyst movably disposed at the exhaust pipe in such a manner that it can at least be moved partially out of the exhaust gas flow current in the exhaust pipe. If the small catalyst serving as the starting catalyst is movably disposed in the exhaust gas pipe and can be moved out of the exhaust gas flow into a lateral chamber of the exhaust gas pipe, overheating can be avoided without the requirement of a bypass pipe and control flaps. After the catalyst is removed from the exhaust gas flow in the exhaust, a smooth passage opening is available to this flow which ensures a low loss of pressure of this flow.

Other objects, advantages and novel features of the present invention will become apparent from the following detailed description of the invention when considered in conjunction with the accompanying drawings.

DETAILED DESCRIPTION OF THE DRAWINGS

Figure 1:
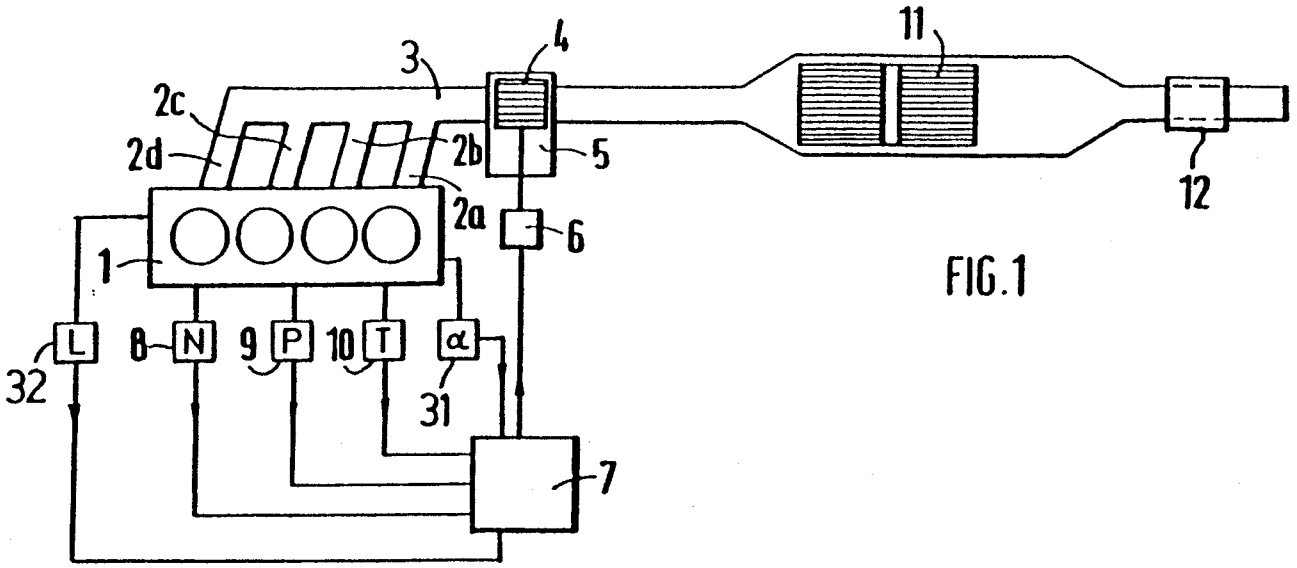
FIG. 1 is a view of the exhaust system of an internal-combustion engine having catalysts.

FIG. 1 shows an internal-combustion engine 1 with four exhaust gas elbows *2a, 2b, 2c, 2d* that extend from the cylinder head and are connected to a common exhaust pipe 3. A catalyst 4 is longitudinally guided to move transversely with respect to the exhaust pipe 3. The movement allows the catalyst 4 to completely move out of the exhaust gas flow and into a lateral chamber 5. An adjusting device 6 is used for controlling entry and exiting of the catalyst and is controlled by a control apparatus 7 in response to a rotational-speed sensor 8, a pressure sensor 9, a temperature sensor 10, a load sensor 32, and a throttle angle sensor 33 of the internal-combustion engine. A second, larger catalyst 11 is fixedly installed downstream of catalyst 4. The exhaust gases which were purified by catalyst 11 exit into atmosphere through a muffler 12.

Figure 2:
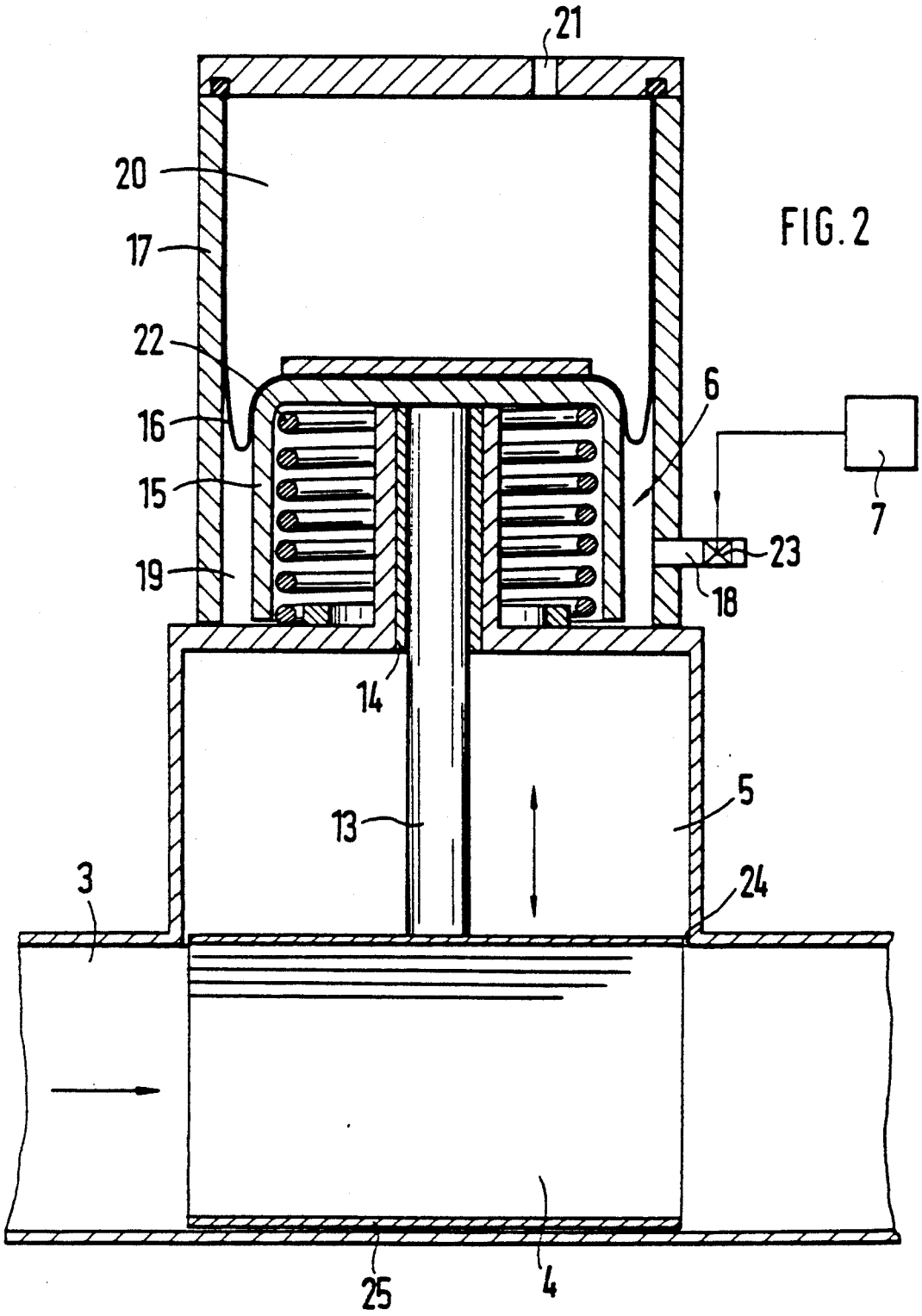
FIG. 2 is a view of a catalyst which is linearly movable in the exhaust pipe.

As shown in FIG. 2, the adjusting device 6 for the catalyst 4 operates pneumatically although it could be actuated hydraulically or electrically. The catalyst 4 can be made of metal or ceramics and may be round or rectangular. A guide rod 13 is fastened to the top of the catalyst 4 and is guided in a bushing 14 of chamber 5. The other end of the guide rod 13 is fastened to a spring motor pot element 15. A roll diaphragm 16 is fastened to the spring pot element 15 and is held in a cylinder 17 located on the chamber 5. A vacuum connection 18 is provided for creating a vacuum in space 19 located between the spring pot element 15 and the cylinder 17, while the cylinder space 20 above the spring pot element 15 is connected with the atmosphere by way of a bore 21.

In the position shown, the vacuum holds the catalyst 4 fully in the exhaust gas flow against the force of a pressure spring 22. If the vacuum is reduced by means of a control valve 23 controlled by the control apparatus 7, the pressure spring 22 lifts the catalyst 4 out of the exhaust pipe 3. The chamber 5 is constructed such that it can fully accommodate the catalyst 4 and surrounds it with a narrow gap 24. Since in this moved-out position, the bottom 25 of the catalyst 4 covers the exhaust pipe 3 from above, no noticeable swirl is created in the exhaust gas flow and no resulting additional loss of pressure occurs.

Figure 4:
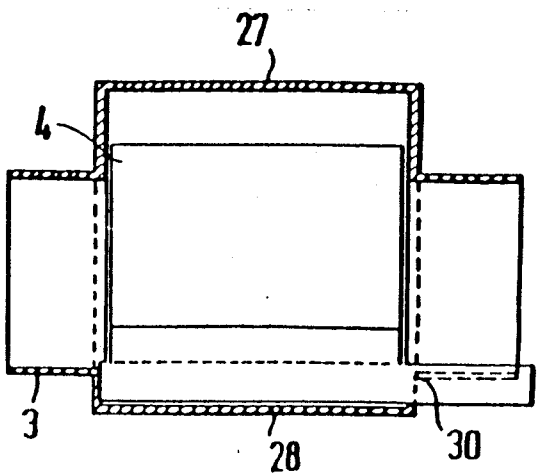
FIG. 4 is a longitudinal sectional view of the device of FIG. 3.
Figure 3:
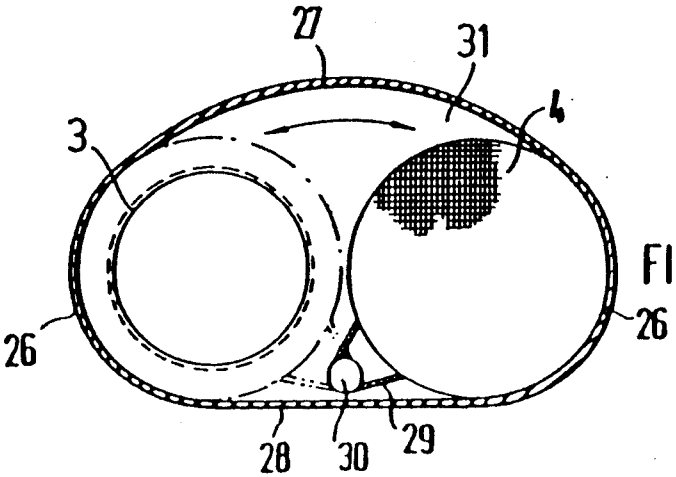
FIG. 3 is a cross-sectional view of a catalyst which can be swivelled in the exhaust pipe.

In another embodiment of the invention according to FIG. 3 and FIG. 4, the cylindrical catalyst 4 can be pivoted into and out of the exhaust pipe 3. At the installation point of the catalyst 4, the exhaust pipe 3 has an oval cross-section consisting of two diametrically opposite smaller circular arc portions 26, one larger circular arc portion 27 and one straight line portion 28. A sheet-metal bracket 29 is mounted on the outside of catalyst 4 to be swivelled around a bearing point 30 fixed in the exhaust pipe 3. This bearing point 30 is located close to the straight line portion 28 and in the center between the two smaller circular arcs 26.

In the two drawn end positions of the swivel motion, the catalyst 4 rests on the inside of the smaller circular arc portions 26 along a large part of its circumference because it has approximately the same outside diameter as the circular arc portions 26. In the left end position, the catalyst 4 is located completely in the exhaust gas flow, since the exhaust pipe 3 is disposed approximately coaxially with respect to this left end position. By swivelling of the catalyst into the right end position, the catalyst 4 arrives in a dead space 31 with respect to the flow and only a small amount of exhaust gas, if any at all, will still flow through it.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An exhaust system of an internal-combustion engine, having a catalyst arranged in its exhaust pipe;

wherein the catalyst is movably disposed at the exhaust pipe;

wherein there is a control means to move the catalyst at least partially out of exhaust gas flow current in the exhaust pipe;

wherein the catalyst is transversely guided into and out of the exhaust pipe with respect to an axis of the exhaust pipe; and wherein the catalyst is moved out of the exhaust pipe into a lateral chamber adjacent the exhaust pipe by the control means.

2. An exhaust system according to claim 1, wherein the catalyst, in the moved-out position, is surrounded by the lateral chamber with a narrow gap clearance; and wherein a bottom end of the catalyst covers the exhaust pipe.

3. An exhaust system according to claim 1, wherein the control means for moving the catalyst is actuated as a function of any one of temperature, load, pressure, rotational speed and throttle valve angle of the internal-combustion engine.

4. An exhaust system according to claim 2, wherein the control means for moving the catalyst is actuated as a function of any one of temperature, load, pressure, rotational speed and throttle valve angle of the internal-combustion engine.

5. An exhaust system according to claim 1, wherein control means for moving the catalyst can be actuated by any one of pneumatic, electric and hydraulic motor.

6. An exhaust system according to claim 3, wherein control means for moving the catalyst can be actuated by any one of pneumatic, electric and hydraulic motor.

7. An exhaust system according to claim 1, wherein the catalyst is rotatably disposed in the exhaust pipe to be swivelled out of the exhaust gas flow into a lateral dead space with respect to flow in the exhaust pipe.

8. An exhaust system according to claim 7, wherein the exhaust pipe has an oval cross-section at an installation point of the catalyst;

wherein the oval cross-section is created by two smaller circular arc portions, separated by one larger circular arc portion and one straight line portion; and wherein a pivot point of the catalyst is located close to the straight line portion and approximately in the center between the smaller circular arc portion.

9. An exhaust system according to claim 8, wherein the catalyst is cylindrical and its outside diameter is approximately equal in size to a diameter of the smaller circular arc portion.

10. An exhaust system according to claim 8, wherein the catalyst rests on an inside of and against one of the two smaller circular arc portions in end positions of its swivel motion.

11. An exhaust system according to claim 9, wherein the catalyst rests on an inside of and against one of the two smaller circular arc portions in end positions of its swivel motion.

12. An exhaust system according to 1, wherein a second and larger catalyst is fixedly installed in the exhaust pipe downstream of the movable catalyst.

13. An exhaust system according to 2, wherein a second and larger catalyst is fixedly installed in the exhaust pipe downstream of the movable catalyst.

14. An exhaust system according to 3, wherein a second and larger catalyst is fixedly installed in the exhaust pipe downstream of the movable catalyst.

15. An exhaust system according to 7, wherein a second and larger catalyst is fixedly installed in the exhaust pipe downstream of the movable catalyst.

16. An exhaust system according to 8, wherein a second and larger catalyst is fixedly installed in the exhaust pipe downstream of the movable catalyst.

17. An exhaust system according to 9, wherein a second and larger catalyst is fixedly installed in the exhaust pipe downstream of the movable catalyst.

* * * * *